US005138535A

United States Patent [19]

Aragon, Jr.

[11] Patent Number: 5,138,535

[45] Date of Patent: Aug. 11, 1992

[54] INFANT TOY HAVING IMPACT-RESPONSIVE LIGHT GENERATING MEANS

[76] Inventor: William G. Aragon, Jr., 808 Georgia, SE., Albuquerque, N. Mex. 87108

[21] Appl. No.: 570,822

[22] Filed: Aug. 22, 1990

[51] Int. Cl.[5] ..... A63H 30/02

[52] U.S. Cl. ..... 362/102; 362/253; 362/276; 362/802; 362/32; 446/175; 446/419; 446/438

[58] Field of Search ..... 362/32, 109, 102, 802, 362/806, 253, 276; 446/438, 439, 419, 175, 485; 200/60

[56] References Cited

U.S. PATENT DOCUMENTS

| | | | |
|---|---|---|---|
| 2,484,159 | 10/1949 | Flynn, Jr. | 362/802 |
| 2,633,668 | 4/1953 | Schaeffer | 362/802 |
| 3,803,398 | 4/1974 | Wallar | 362/32 |
| 4,588,387 | 5/1986 | Swenson | 446/419 |
| 4,678,450 | 7/1987 | Scolari et al. | 362/102 |
| 4,924,358 | 5/1990 | Von Heck | 362/102 |

FOREIGN PATENT DOCUMENTS

| | | | |
|---|---|---|---|
| 2221626 | 2/1990 | United Kingdom | 446/175 |

*Primary Examiner*—Ira S. Lazarus
*Attorney, Agent, or Firm*—John E. Reilly

[57] ABSTRACT

A baby rattle is made up of a light-transparent shell, a light source in the interior of the shell, an impact or motion-sensing member within the shell will generate an electrical signal to activate a control circuit between the light source and a portable power source to illuminate the shell. The impact motion-sensing member is preferably a piezoelectric crystal mounted within the shell, and a fiber optic array within the shell can be used in association with a light source to create different lighted displays.

9 Claims, 1 Drawing Sheet

INFANT TOY HAVING IMPACT-RESPONSIVE LIGHT GENERATING MEANS

This invention relates to infant toys; and more particularly relates to a novel and improved illuminable toy for infants and toddlers.

BACKGROUND AND FIELD OF THE INVENTION

Baby rattles have long been a source of amusement for infants. Typically, rattles are extremely lightweight and compact so that they can be easily grasped and shaken by babies at an extremely early age to emit different sounds or noises. It is desirable to further enhance the attractiveness of baby rattles and other toys by causing them to become illuminated when shaken.

Presently, toys are commercially available which will emit sparks or can be activated by the child to display blinking lights. However, to the best of my knowledge, no one has satisfactorily devised a way to incorporate a light source into a rattle and such that the light source is activated as a result of the impact of the loose particles within the rattle in the shell so that all or selected portions of the shell are illuminated; and further wherein the light source can be incorporated into the rattle or other toy without a substantial increase in weight or size.

In my copending application for patent Ser. No. 467,675 and entitled MOTION SENSITIVE, FIBER OPTIC, STRIKE INDICATING FISHING ROD ASSEMBLY, there is set forth and described a fishing rod assembly in which a motion sensor in the rod will activate a light source to create a visual warning that a fish has struck the line.

SUMMARY OF THE INVENTION

It is therefore an object of the present invention to provide for a novel and improved amusement device and particularly of the type which can be selectively illuminated either as a result of motion or impact and which, for example, may be initiated by manual shaking.

Another object of the present invention is to provide for a novel and improved infant toy which is extremely lightweight and compact and contains a light source which can be selectively illuminated by the infant.

It is a further object of the present invention to provide in a toy for a light source which can be selectively energized in response to motion or impact, is of simplified construction and is inexpensive to manufacture.

In accordance with the present invention an illuminable toy comprises a light-transparent hollow shell, a light source in communication with the interior of the shell, a portable power source and circuit control means between the light source and power source for energizing the light source, particles loosely disposed in the shell, and impact sensing means within the shell and responsive to impact with said particles to generate an electrical signal for activating said circuit control means. In a preferred embodiment of the present invention, the light source may consist of a suitable LED display or incandescent light and preferably positioned at one end of a handle in communication with the interior of the shell; and the impact sensing means is defined by a piezzoelectric crystal secured to the shell whereby motion of the rattle causing the particles to contact the crystal will activate the circuit control means.

As an extension of the light source, fiber optic elements may be aligned at one end with the light source for transmission of the light through each element.

The above and other objects of the present invention will become more readily appreciated and understood from a consideration of the following detailed description of a preferred embodiment when taken together with the accompanying drawings wherein:

DETAILED DESCRIPTION OF THE PREFERRED EMBODIMENT

Figure 2:
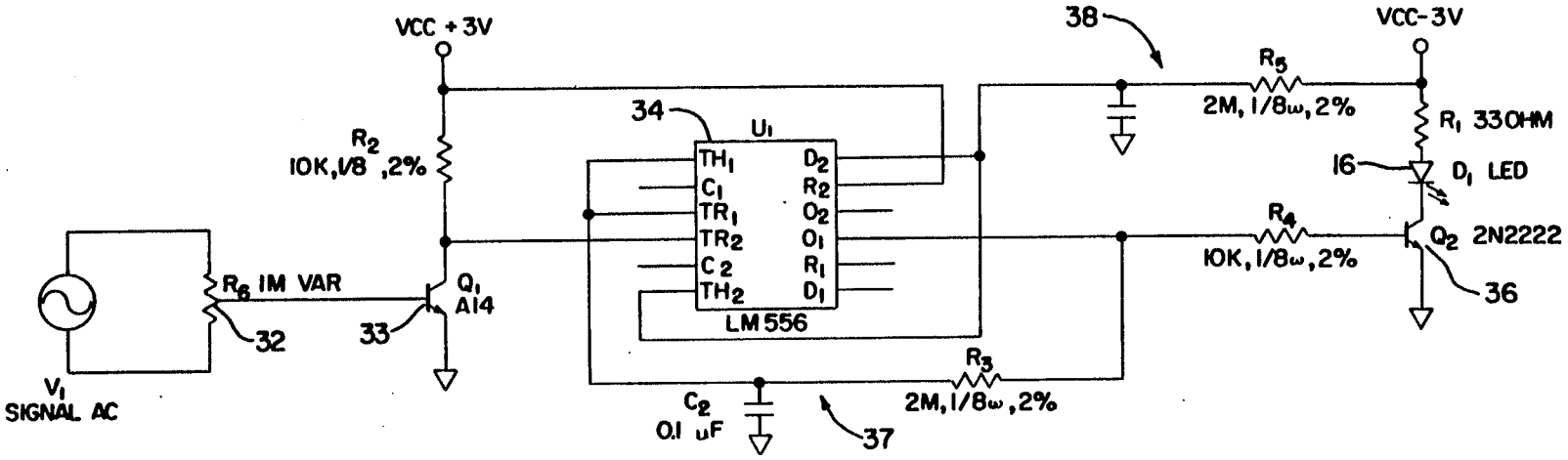
FIG. 2 is a schematic view of a preferred form of control circuit utilized to activate a light source in the preferred form of invention.
Figure 1:
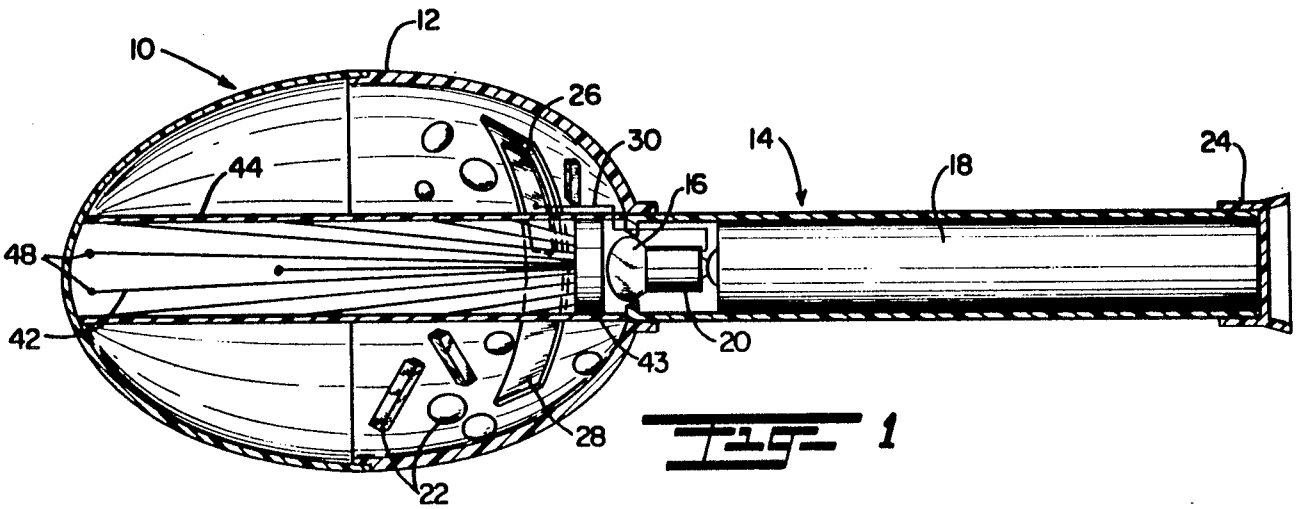
FIG. 1 is a cross-sectional view of a preferred embodiment of toy in accordance with the present invention and schematically illustrating the interrelationship between elements of the light source.

Referring in detail to the drawings, a preferred form of baby toy in the form of a rattle 10 is broadly comprised of an outer light-transparent shell or housing 12, a handle 14, light source 16 and portable power supply 18 with circuit control means 20 interposed between the power supply 18 and light source 16.

The preferred form of shell 12 contains loose particles 22 in the form of marbles or other small pieces, and the shell itself is suitably composed of a rigid but lightweight plastic material which is capable of withstanding the impact of the particles 22 without breaking.

Preferably, the shell 12 is generally oval-shaped, and the handle is in the form of an elongated tubular rod communicating at one end with one end of the oval-shaped shell. The opposite end of the handle is closed by a flexible cap 24 which is bonded or otherwise sealed to the end.

An impact-sensing element 26 is preferably defined by a piezzoelectric crystal in the form of an extremely thin transducer strip on the order of 52$\mu$M securely affixed to a bonding strip 28 which is secured to the interior of the shell 12 adjacent to the one end to which the handle 14 is attached. An electrical lead 30 extends from the crystal to the control circuit 20.

Whenever the crystal is energized, the electrical lead 30 will deliver a small output current to the control circuit 20. This current is applied across a potentiometer 32, the output of which is connected to the base of a transistor 33. The sensitivity of the crystal or sensor 26 can be modified by adjusting the effective resistance of the potentiometer 32 in a well-known manner, and the collector of the transistor 33 triggers a timer circuit 34 and which may consist of a first timer control which will select the time that the light source will be activated and is determined by a reset pin on a second timer section, the second timer section controlling the flash rate of the light source 16. An output from the timer circuit biases a second transistor 36 to activate the light source 16. This application requires standby power consumption to be minimal in order to increase battery life and to this end high impedance resistors and capacitors forming part of RC networks are generally designated at 37 and 38 respectively. The resultant circuit is an extremely compact unit which can be incorporated onto a small chip or card within the handle 14 to produce the necessary output to illuminate the light source 16 at a predetermined flash rate.

In the preferred form, a plurality of light-transmitting, fiber optic leads 42 are bundled together at one end 44 so that the ends of the leads 42 are directly exposed to the light source 16. The leads 42 may be of varied lengths and contained within a common tubular member 44. The member 44 is preferably affixed at one end to the end of the handle 14 for extension centrally through the interior of the shell 12 and to terminate at the opposite end of the shell. Thus, when the light source 60 is activated, it will admit light through the fiber optic elements 42 so as to be visible at their ends 48 at spaced intervals along the length of the tubular member 44. If the tubular member 44 is transparent, it is sufficient merely to place the elements 42 therein and their opposite lighted ends 48 will be visible through the thickness of the rod, but if the rod is made of an opaque material the ends of the elements 42 should be embedded in the wall of the rod flush with the external surface of the tubular member so as to be visible to the child when activated.

The crystal may be of a type that is either motion or impact responsive in generating a current via electrical lead 30 to the control circuit 20. For example, one suitable form of crystal is the Piezzo Film Transducer manufactured and sold by Pennwalt Corporation of Folsom, Calif. By placing the crystal within the interior of the shell so as to be exposed to the rattle particles 22, when the rattle is shaken or moved, the crystal will generate the necessary electrical current to activate the control circuit 20 and energize the light source 16. Thus, the light source will be activated at a predetermined flash rate and in turn emit same to the fiber optic elements 42 to generate blinking lights along the length of the tubular member 44.

It will be evident from the foregoing that the fiber optic bundle including the tubular member 44 may be eliminated and rely entirely on the light source 16 to produce the desired flashing light; also that various different arrays of fiber optic elements may be utilized by modifying the configuration of the supporting member 44. In this relation, it will be further apparent that various different rattle configurations may be provided and which can be activated either by motion, impact or a combination of motion and impact to produce the desired lighting effect.

It is therefore to be understood that while a preferred form of invention has been herein set forth and described, various modifications and changes may be made without departing from the spirit and scope of the present invention as defined by the appended claims and reasonable equivalents thereof.

I claim:

1. A illuminable toy in the form of a baby rattle comprising:

a light-transparent hollow shell;

a plurality of particles loosely disposed in said shell;

circuit control means including impact-sensing means in said shell responsive to impact with said particles to generate an electrical signal when said rattle is shaken;

a light source in communication with the interior of said shell; and a portable power source, said circuit control means electrically connected between said light source and said power source and responsive to the electrical signal generated by said impact-sensing means for energizing said light source to illuminate said shell.

2. An illuminable toy according to claim 1, including a handle connected to said shell, and said light source and said power source disposed in said handle.

3. An illuminable toy according to claim 1, said impact sensing means including a piezzoelectric crystal secured to said shell whereby motion of said rattle causing said particles to contact said crystal will activate said circuit control means.

4. An illuminable toy according to claim 3, said crystal being in the form of a flexible strip affixed to an interior surface of said shell.

5. An illuminable toy according to claim 1, including at least one light-transmitting fiber optic element in said shell having one end aligned with said light source for the transmission of light through said fiber optic element when said light source is activated.

6. An illuminable toy in the form of a baby rattle comprising:

a transparent hollow shell;

a light source in communication with the interior of said shell;

particles loosely disposed in said shell;

circuit control means including sensing means in said shell responsive to impact with said particles to generate an electrical signal when said shell is shaken; and a portable power source, said circuit control means electrically connected between said light source and said power source responsive to electrical signals from said sensing means for energizing said light source, said sensing means including a piezzoelectric crystal secured to said shell whereby motion of said rattle causing said particles to contact said crystal will generate electrical signals.

7. An illuminable toy according to claim 6, including a handle in the form of a hollow rod connected to said shell, and said light source and said power source disposed in said handle.

8. An illuminable toy according to claim 6, said crystal mounted on a flexible strip affixed to an interior surface of said shell.

9. An illuminable tory according to claim 6, including a plurality of light-transmitting fiber optic elements of varying lengths disposed within said shell having one end aligned with said light source for the transmission of light through said fiber optic elements when said light source is activated.

* * * * *